United States Patent [19]

Donovan et al.

[11] Patent Number: 5,016,716

[45] Date of Patent: May 21, 1991

[54] TUBING CARRIED PERFORATING GUN WITH INSULATION JACKET

[75] Inventors: Joseph F. Donovan, Spring; Donald N. Yates, Jr., Palacios, both of Tex.

[73] Assignee: Baker Hughes Incorporated, Houston, Tex.

[21] Appl. No.: 514,850

[22] Filed: Apr. 25, 1990

[51] Int. Cl.[5] ..... E21B 36/00; E21B 21/14; E21B 41/116

[52] U.S. Cl. ..... 175/17; 166/302; 166/312; 166/57; 175/4.52; 175/4.54

[58] Field of Search ..... 116/57, 302, 312, 311, 116/55, 55.1, 297, 299, 63; 175/17, 4.5, 4.52, 4.54, 4.56, 4.57, 4.6, 57

[56] References Cited

U.S. PATENT DOCUMENTS 4,436,155 3/1984 Brieger ..... 175/4.52 X

FOREIGN PATENT DOCUMENTS 2544376 10/1984 France ..... 175/17

*Primary Examiner*—Stephen J. Novosad
*Attorney, Agent, or Firm*—Rosenblatt & Associates

[57] ABSTRACT

An insulation jacket and method are provided for a tubing carried perforating gun for a subterranean well. A tubular housing is secured at one end to a tubular conduit with a firing head disposed interiorly within the housing. A perforating gun is activated by the firing head and carried by the housing. A tubular heat shield is concentrically disposed around the exterior of the housing and is sealingly secured relative to an end of the housing. An annular area is defined between the interior of the heat shield and the exterior of the housing with a fluid passageway extending from the interior of the housing through the annular area and communicating with the exterior of the heat shield. The heat shield configuration may also be utilized to provide an annular wash area for washing particulate matter away from the perforating gun as it is being introduced into the well. A cooling fluid may be introduced into the well during or incremental to running of the tubing into the well and circulated through the fluid passageway.

5 Claims, 1 Drawing Sheet

TUBING CARRIED PERFORATING GUN WITH INSULATION JACKET

BACKGROUND OF THE INVENTION

1. Field of the Invention

The invention relates to a tubing carried perforating gun having an insulation jacket for use in a subterranean well.

2. Brief Description of the Prior Art

During the completion or workover of a subterranean oil or gas well, a casing conduit is run into the well subsequent to the drilling thereof and is cemented into place. In order to provide a passageway for production of the fluid hydrocarbons from one or more production zones within the subterranean well, it is necessary to perforate the metallic casing to provide openings communicating with passageways through the zone for production of the hydrocarbon fluids therethrough. In such instance, a perforating "gun", well known to those skilled in the art is utilized. Such gun may be introduced into the well on a tubular conduit, such as a workstring, or in the case of a permanent completion incorporating the perforating gun, a production conduit. Typically, the perforating gun will have immediately thereabove a percussion actuated firing head for firing of the gun. The firing head/gun assembly may be introduced into the well below a permanent or retrievable bridge plug or packer. The packer is set immediately above the zone to be perforated and the gun may be fired in numerous ways known to those skilled in the art. For example, a heavy bar may be introduced through the tubing string to drop upon the firing pin of the firing head to initiate the chain of events that ultimately results in the gun being firing. Alternatively, the firing head may be activated by variation in tubing and/or annulus pressure, or may be electrically o acoustically activated.

The perforating gun may incorporate a number of configurations and normally will have a series of radially extending longitudinally spaced shaped charges which, when fired, shoot holes through the casing.

As wells are drilled to deeper depths, along the order of 20 to 30 thousand feet, and more, the temperatures encountered are increased substantially and have been known to adversely affect the actuation devices of either the firing head and/or perforating gun.

During the running of perforating guns into the well, particulate matter in the form of cuttings and other debris may interfere with the running of the perforating gun on the tubing into the well during the completion operation. A substantial collection of such debris at a point of deviation in the well bore can result in differential sticking of the gun and/or tubing relative to the casing such that manipulation of the tubing must be effected to unstick the gun at that particular point, thus necessitating considerable and additional rig time and delaying the completion of the well.

SUMMARY OF THE INVENTION

The present invention addresses the problems set forth above by providing a thermal heat shield exterior of the firing head/perforating gun assembly, thereby providing an annular area defined by the interior of the heat shield and the exterior of the firing head and perforating gun through which a cooling fluid is introduced through the tubing conduit carrying the firing head and gun into the well and which may be circulated through the annular area and exteriorly thereof to the top of the well.

The present invention also provides a means and method of washing around the exterior of the firing head and perforating gun or other tool as the tubing string carrying the gun assembly is introduced into the well to avoid differential sticking problems and other similar situations.

DESCRIPTION OF THE PREFERRED EMBODIMENTS

Figure 1:
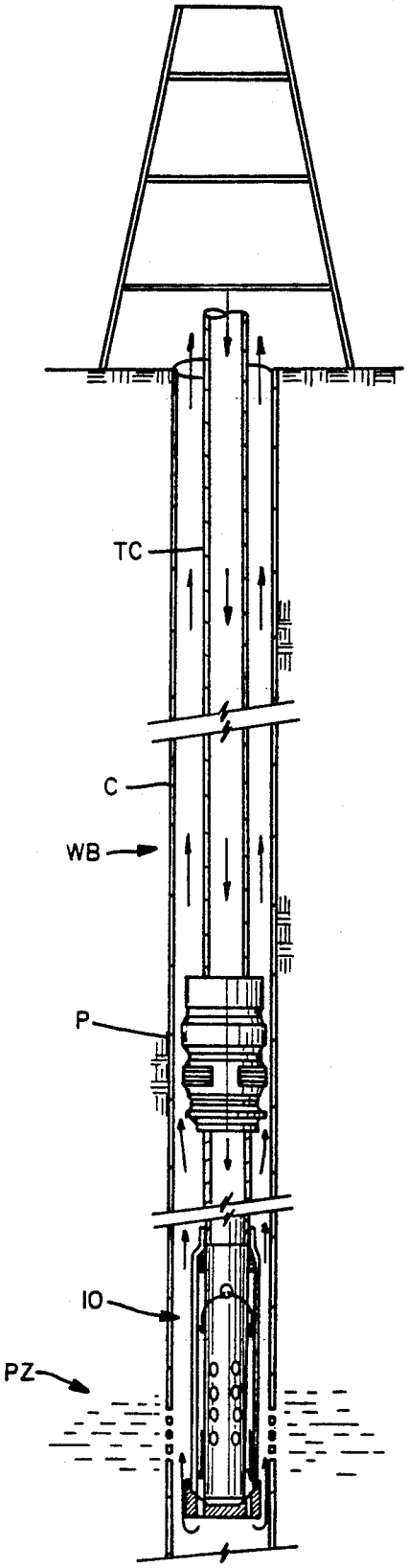
FIG. 1 is a longitudinally extending sectional view of a subterranean well bore with a tubing conduit extending through an encased well with the perforating gun insulation assembly of the present invention affixed thereon.
Figure 2:
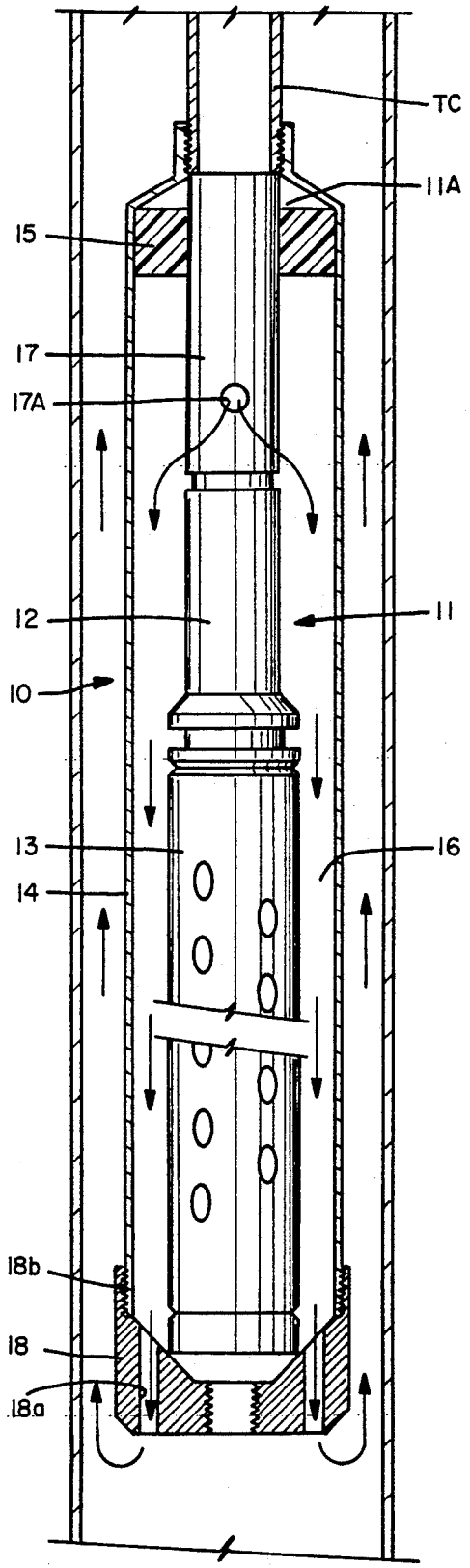
FIG. 2 is a detailed longitudinal sectional view of the apparatus of the present invention with the cooling fluid flow path indicated by arrows.

With reference to FIG. 1, there is shown a well bore WB which has cementitiously secured therein a casing C. A production zone PZ is disposed within the well, and it is this area of the well bore WB that is desired to be perforated. A tubular conduit TC, such as a workstring, is shown as being run into the well and has a packer P in running-in position immediately above the uppermost end of the production zone PZ.

Below the packer P and carried on the tubular conduit TC is the apparatus 10 which comprises a cylindrical housing 11 having one end 11*a* which is secured to the tubular conduit TC. The end 11*a* may be directly or indirectly secured to the tubular conduit TC. In other words, other tools, such as ported subs, testing valves, or the like, may be disposed on the tubular conduit TC directly above the upper end 11*a*. In any event, the end 11*a* secures the apparatus 10 for carriage into the well by the tubular conduit TC.

A ported sub 17 is carried just above a firing head 12 which, in turn, is positioned immediately above a perforating gun 13. The ported sub 17 has a port 17*a* extending between the interior of the tubular conduit TC and the interior of the housing 11 for transmission of cooling fluid, discussed below. An elastomeric or metallic seal or other fluid diversion means 15 is disposed between the outer diameter of the ported sub 17 and the interior of a cylindrical longitudinally extending heat shield 14 which, in turn, has at its lowermost end a ported anchor 18 having ported passageways 18*a* disposed through its lowermost end. The ported anchor 18 is threadably secured at 18*b* to the lowermost end of the heat shield 14. An annular area 16 is defined between the housing 11 and the thermal heat shield 14 below the seal 15 and communicates with the ported sub 18 at its uppermost end and terminates through the ports 18*a* at the lowermost end of the ported anchor 18.

The heat shield 14 may be secured to the housing 11 or tubular conduit TC directly through the seal 15 or may be directly welded therethrough by means of a weld as, for example, just above the uppermost end of the seal 15.

The heat shield 14 may be constructed of any known materials, such as N-80 steel or any other material which is known to absorb heat and which can be run in the well. The heat shield 14 may be provided in the form of insulated tubing which is utilized in steam injection wells and the like, but should be of a compatible material such that the temperature within the annulus 16 may be kept below the working limits of explosives in the firing head and the perforating gun. The object of the shield 14 is to confine the flow of the cooling fluid to the annular space between the i.d. of the shield 14 and the o.d. of the gun. The fluid itself will now be able to absorb the heat to keep it away from the gun.

The cooling fluid used in conjunction with the apparatus 10 and the method of the present invention may simply be water which is available at the well site. Alternatively, such fluid may be a brine, a gel, or a polymer which is resistant to adverse effects of temperature increase and which absorbs heat.

In operation, the apparatus 10 is secured to the tubular conduit TC at the top of the well with the firing head 12 positioned just above the gun 13 and the ported sub 7 secured to the uppermost end of the firing head 12. The heat shield 14 will surround the exterior of the housing 11 of this continuation. The apparatus 10 is run into the well on the tubular conduit TC until it is positioned horizontally across the production zone PZ.

In one embodiment, the cooling fluid is introduced through the tubular conduit TC at the top of the well and is pumped through the tubular conduit TC as the apparatus 10 is being run into the well. Alternatively, the cooling fluid may be circulated into the tubular conduit TC and through the annular area 16 incrementally from time to time as needed as the apparatus 10 is run into the well, or subsequent to the setting of the packer P. Preferably, the cooling fluid will be circulated through the tubular conduit TC while the apparatus 10 is being run in the well, but is initiated before the depth at which an adverse temperature is expected to be encountered. In any event, the cooling fluid will be circulated through the tubular conduit TC, out the port 17*a* and into the annular area 16 where it is exposed to the temperatures around the outer housing of the perforating gun 13, thereby absorbing heat in combination with the heat shield 14.

The cooling fluid may be circulated through the annular area 16 and out of such area 16 through the lowermost end of the ported anchor 18 at the port 18*a*. Thereafter, the circulation flow path will be in the annular area defined by the interior of the casing C and the exterior of the heat shield 14. The fluid may pass upwardly through a crossover assembly (not shown), or the like, to the top of the well. If a packer P is not used or set, the circulation fluid will continue in the annulus between the casing C and the tubular conduit TC to the top of the well.

In addition to providing thermal abatement while the apparatus 10 is being run and prior to activation of the gun 13, the apparatus 10 will also provide means for washing a gun or other tool 13 to the bottom of the well bore WB to remove contaminants and other solids. The apparatus 10 may also be utilized to displace fluids, such as a heavily weighted kill fluid as the apparatus 10 or other tool is being run into the well bore WB.

Although the invention has been described in terms of specified embodiments which ar set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A method of insulating a tubing carried perforating gun which is run through a subterranean well bore, comprising the steps of:

(1) making up at the well surface a tubing string for introduction within said well, said tubing string carrying a perforating gun assembly comprising:
  (a) a tubular housing securable at one end to a tubular conduit member;
  (b) a firing head disposed interiorly within said housing;
  (c) a perforating gun activated by said firing head and carried by said housing;
  (d) a tubular heat shield disposed around the exterior of said housing and secured relative to one end of said housing, said tubular heat shield having an opening extending immediate the lowermost end thereof;
  (e) an annular area defined between the interior of said heat shield and the exterior of said tubular housing; and
  (f) a fluid passageway extending from the interior of said tubular housing through the annular area and through the opening in said heat shield.

(2) running said tubing string with said perforating gun assembly carried thereon into the well to a pre-selected location; and (3) simultaneously while performing Step (2) introducing through the tubing string at the top of the well bore a cooling fluid and circulating said cooling fluid down the tubing string, through the fluid passageway and upwardly around the exterior of the gun assembly to the top of the well bore.

2. A method of insulating a tubing carried perforating gun which is run through a subterranean well bore, comprising the steps of:

(1) making up at the well surface a tubing string for introduction within said well, said tubing string carrying a perforating gu assembly comprising:
  (a) a tubular housing securable at one end to a tubular conduit member;
  (b) a firing head disposed interiorly within said housing;
  (c) a perforating gun activated by said firing head and carried by said housing;
  (d) a tubular heat shield disposed around the exterior of said housing and secured relative to one end of said housing, said tubular heat shield having an opening extending immediate the lowermost end thereof;
  (e) an annular area defined between the interior of said heat shield and the exterior of said tubular housing; and
  (f) a fluid passageway extending from the interior of said tubular housing through the annular area and through the opening in said heat shield.

(2) running said tubing string with said perforating gun carried thereon into the well to a pre-selected location; and (3) simultaneously while performing Step (2) introducing into said tubing string a cooling fluid and transmitting the cooling fluid downwardly through the tubing string and through the fluid passageway.

3. A method of insulating a tubing carried perforating gun which is run through a subterranean well bore, comprising the steps of:

(1) making up at the well surface a tubing string for introduction within said well, said tubing string carrying a perforating gun assembly comprising:
(a) a tubular housing securable at one end to a tubular conduit member;
(b) a firing head disposed interiorly within said housing;
(c) a perforating gun activated by said firing head and carried by said housing;
(d) a tubular heat shield disposed around the exterior of said housing and secured relative to one end of said housing, said tubular heat shield having an opening extending immediate the lowermost end thereof;
(e) an annular area defined between the interior of said heat shield and the exterior of said tubular housing; and
(f) a fluid passageway extending from the interior of said tubular housing through the annular area and through the opening in said heat shield.
(2) running said tubing string with said perforating gun assembly carried thereon into the well to a pre-selected location; and
(3) simultaneously while performing Step (2) introducing a cooling fluid into the annular area.

4. A method of insulating a tubing carried perforating gun which is run through a subterranean well bore, comprising the steps of:
(1) making up at the well surface a tubing string for introduction within said well, said tubing string carrying a perforating gun assembly comprising:
(a) a tubular housing securable at one end to a tubular conduit member;
(b) a firing head disposed interiorly within said housing;
(c) a perforating gun activated by said firing head and carried by said housing;
(d) a tubular heat shield disposed around the exterior of said housing and secured relative to one end of said housing, said tubular heat shield having an opening extending immediate the lowermost end thereof;
(e) an annular area defined between the interior of said heat shield and the exterior of said tubular housing; and
(f) a fluid passageway extending from the interior of said tubular housing through the annular area and through the opening in said heat shield.
(2) running said tubing string with said perforating gun assembly carried thereon into the well to a pre-selected location; and
(3) introducing through the tubing string at the top of the well bore a cooling fluid and circulating said cooling fluid down the tubing string, through the fluid passageway and upwardly around the exterior of the gun assembly to the top of the well bore.

5. A method of insulating a tubing carried perforating gun which is run through a subterranean well bore, comprising the steps of:
(1) making up at the well surface a tubing string for introduction within said well, said tubing string carrying a perforating gun assembly comprising:
(a) a tubular housing securable at one end to a tubular conduit member;
(b) a firing head disposed interiorly within said housing;
(c) a perforating gun activated by said firing head and carried by said housing;
(d) a tubular heat shield disposed around the exterior of said housing and secured relative to one end of said housing, said tubular heat shield having an opening extending immediate the lowermost end thereof;
(e) an annular area defined between the interior of said heat shield and the exterior of said tubular housing; and
(f) a fluid passageway extending from the interior of said tubular housing through the annular area and through the opening in said heat shield.
(2) running said tubing string with said perforating gun assembly carried thereon into the well to a pre-selected location; and
(3) introducing into said tubing string at the top of the well a cooling fluid and transmitting same downwardly through the tubing string and through the fluid passageway.

* * * * *